US007677390B2

(12) United States Patent
Roesler

(10) Patent No.: US 7,677,390 B2
(45) Date of Patent: Mar. 16, 2010

(54) INDIVIDUAL PACKAGING UNIT FOR PRECISION TOOLS

(76) Inventor: Peter Roesler, Ifenweg 3, Wangen/Allgau (DE) D-88239

( * ) Notice: Subject to any disclaimer, the term of this patent is extended or adjusted under 35 U.S.C. 154(b) by 287 days.

(21) Appl. No.: 12/024,491

(22) Filed: Feb. 1, 2008

(65) Prior Publication Data

US 2008/0185305 A1 Aug. 7, 2008

(30) Foreign Application Priority Data

Feb. 3, 2007 (DE) ..... 10 2007 005 515

(51) Int. Cl.
*B65D 85/28* (2006.01)

(52) U.S. Cl. ..... 206/379; 206/446; 206/477; 206/486

(58) Field of Classification Search ..... 206/349, 206/372–379, 443, 446, 477, 486; 53/473, 53/476, 478; 211/69, 70.6
See application file for complete search history.

(56) References Cited

U.S. PATENT DOCUMENTS

| | | | | |
|---|---|---|---|---|
| 2,246,642 | A * | 6/1941 | Stachowiak | 206/270 |
| 2,568,089 | A * | 9/1951 | Pendleton | 211/69 |
| 3,208,606 | A * | 9/1965 | Epstein et al. | 206/372 |
| 5,967,318 | A * | 10/1999 | Rosler | 206/372 |
| 7,331,455 | B2 * | 2/2008 | Lin | 206/372 |
| 2006/0283769 | A1 * | 12/2006 | Roesler | 206/379 |
| 2007/0138043 | A1 * | 6/2007 | Roesler | 206/379 |

FOREIGN PATENT DOCUMENTS

DE 102005022385 A1 11/2006

* cited by examiner

*Primary Examiner*—Luan K Bui
(74) *Attorney, Agent, or Firm*—Frederick L. Tolhurts, Esq.; Cohen & Grigsby, P.C.

(57) ABSTRACT

An individual packaging unit for precision tools that includes a base part with a receiving opening for receiving a shaft of a breakable object loosely and with clearance. A protective part with a groove-shaped receiving device for anchoring the precision tool is disposed on the base part in a way to be pivotable, said protective part comprising at least two functionally separate portions wherein one portion is a clamping part, and the other portion is a receiving part. The individual packaging unit is closed with a push-on protective cap that is pushed in a longitudinal direction to engage the base part. The clamping part clamps the precision tool when the protective cap is pushed onto the individual packaging unit.

19 Claims, 4 Drawing Sheets

INDIVIDUAL PACKAGING UNIT FOR PRECISION TOOLS

BACKGROUND OF THE INVENTION

The object of the invention is an individual packaging unit for precision tools wherein a base is hinged to a protective part. The protective part is pivoted over the tool to secure the tool and a protective cap is longitudinally extended over the protective part to further secure the tool.

An individual packaging unit is known from the patent application DE 10 2005 022 385 A1 filed by the same applicant. The individual packaging unit shown therein includes a bottom base part forming a receiving opening for receiving a breakable object, in particular, a precision tool. The receiving opening is open on one end and equipped with corresponding clamping ribs. The receiving opening is disposed in the base part. The shaft of a precision tool that is to be held therein can be pressed into the receiving opening from the front.

Furthermore, a protective part is connected to the base part and is pivotable around a horizontal axis. The protective part also forms a groove-shaped receiving device for receiving the precision tool to be protected. Corresponding clamping receiving devices for anchoring the precision tool are disposed in the area of the receiving groove.

Furthermore, a protective cap that can be pushed onto the individual packaging unit in the longitudinal direction of the entire individual packaging unit is provided. The protective cap can be pushed from above first over the protective part and then onto the base part, in order to thereby close the groove-shaped receiving device that is open on one side wherein the tool is lodged. The protective cap uses corresponding engagement protrusions to engage corresponding engagement protrusions in the base part.

An individual packaging unit of this type for precision tools has proven itself to a large extent. A disadvantage, however, is that it does not allow automatic loading of the corresponding precision tools or of other breakable objects, because the receiving opening disposed in the base part includes clamping protrusions. This prevents automatic loading because a relatively strong insertion force is needed to insert a precision tool to be protected into the receiving device open on one side in the base part.

There is also disclosed an additional embodiment wherein a receiving device that is not equipped with clamping means is disposed in the base part. A loading process then occurs by which first the protective part and the base part are brought into the same axis, thereby forming a continuous receiving opening from the two parts. Clamping means can be provided in the receiving groove of the protective part. The tool to be held then is pressed into the receiving groove so that the tool bridges the horizontal rocket pivot—formed from a film hinge—between the base part and the protective part and is pressed into the entire receiving groove in longitudinal direction.

The loading process—in particular, when in addition clamping means are provided in the receiving groove of the protective part—implies a very difficult mechanized, automated loading process, because the tool to be held has to be pressed into the continuous receiving groove of the protective part and the base part with relatively keen sensitivity.

After the loading process is completed, a cap can be pushed onto the entire part, the underside of the cap engaging correlated protrusions of the base part. The cap then only serves the purpose of preventing the tool from dropping out of the groove which is open toward the front.

A disadvantage of the embodiment known to the art is the relatively difficult loading of the breakable precision tool into the individual packaging unit as well as the fact that the precision tool can only be insufficiently clamped into a receiving groove.

The patent application named only discloses strap-shaped elastic ears forming a clamping receiving device, due to which the clamping force exerted onto the tool to be held is not very strong.

This then is a relatively undefined clamping force brought to bear on the precision tool. In the case of larger and heavier precision tools, therefore, there is the disadvantage that the insufficiently defined clamping force leads to the risk that if the individual packaging unit is hit on the head, the tool to be protected will move within the receiving groove or even be damaged.

SUMMARY OF THE INVENTION

The invention therefore has the object of improving an individual packaging unit according to the subject matter of the patent application DE 10 2005 022 385 A1 in such a way that during a simplified automated loading process, a defined clamping force is applied to the precision tool to be held while the individual packaging unit is in closed state.

In order to solve the stated object, a packaging unit includes a base that defines an opening for receiving a precision tool or other breakable object. The opening is sized so that it receives the tool and the tool loosely fits within the opening so that there is clearance between the sides of the opening and the tool. The packaging unit also includes a protective part that has a groove-shaped receiving device for securing the tool. The receiving device is pivotally connected to the base and includes at least a clamping part and a receiving part. The packaging unit further includes a protective cap that can be moved in a longitudinal direction over the protective part to engage the base part and to close the packaging unit. The clamping part clamps the tool in response to the longitudinal movement of the protective cap over the clamping part of the receiving device.

Preferably, the individual packaging unit is equipped with a lower base part (2) with a receiving opening (10) for receiving a shaft of a breakable object, wherein a protective part (3) with a groove-shaped receiving device for anchoring the precision tool (7) is disposed on the base part in a way to be pivotable, and wherein the individual packaging unit can be closed in longitudinal direction with a push-on protective cap by means of engagement with the base part, characterized in that the receiving opening (10) designed in the base part (2) loosely and with clearance receives the tool to be held (7) and that the protective part (3) comprises at least two functionally separate parts whereof one part is designed as a clamping part (4) and the other part, as a receiving part (5), wherein the clamping part (4) clamps the precision tool (7) due to the protective cap (24) being pushed onto the individual packaging unit (1).

One feature of the invention is that the receiving opening designed in the base part receives the tool to be held with clearance (i.e. loosely). Also, the protective part comprises at least two functionally separate parts, namely, a clamping part and a receiving part that is without clamping function. Further, in response to the protective cap being pushed onto the individual packaging unit, the clamping part included in the protective part clamps the precision tool.

By pushing a cap onto a protective part that is held pivotably on the base part in a horizontal axis, a defined clamping effect is exerted onto a precision tool that is held therein.

Consequently, any strap-like or barb-like elastic tongues as shown in the patent application DE 10 2005 022 385 A1 may be omitted. Rather, according to the present invention, a defined clamping effect is achieved because the precision tool is only clamped and held by pushing the cap onto the protective part in the area of the clamping part of the protective part. As long as the protective cap is not pushed over the protective part, the clamping part exerts only a slight clamping effect on the tool in the manner of a device securing an item in its position.

In this way, several advantages not known to the art from the prior patent application are derived.

The disclosed embodiment includes three functionally separate parts:

The tool to be held is seated loosely in the receiving space of the base part so that it is possible to automatically load the tool into the base part from above. For automated loading, the tool is dropped shaft first into the receiving opening of the base part in the direction of the longitudinal axis of the tool.

A protective part that is pivotally connected to the base part in a horizontal axis includes two different, functionally separate parts:

a. a clamping part with clamping centering ribs wherein the clamping of the centering ribs is reinforced or increased by pushing on the protective cap, and b. a receiving part that does not have clamping receiving devices and that protectively envelopes the upper part of the tool in the form of a U-profile.

In the presently disclosed invention it is important that no clamping effect is achieved in the base part so that there, the shaft of the precision tool is relatively loose and freely mobile. This makes automated loading easier because the automated loading does not require any pushing tool to insert the precision tool into corresponding receiving openings of the base part by overcoming friction tightness. Rather, in a preferred refinement, the invention provides for the receiving opening in the base part to have clearance so that the precision tool to be held can be dropped into the receiving opening.

Of course, the invention is not restricted to a receiving opening of this type with clearance in the base part. A slightly clamping seating, as well, can be provided. In any case, care is taken that the breakable object to be protected can be easily introduced into the base part without additional mechanized loading tools and pushers. A clamping bond or a great clamping effect is not provided in the base part.

Furthermore, it is of importance that in the protective part, as well, said protective part being subsequently pivoted onto the precision tool to be protected, only a small clamping effect is exerted on the object to be held. There is a clamping effect—solely serving to secure the item in its position—, generated by one or two or several clamping receiving devices disposed at a distance from one another and arranged in alignment with one another.

The centering ribs form clamping receiving devices disposed one behind the other and into which the tool to be held is pressed when the protective part is pivoted out of the position of being folded away from the base part into a position in which the protective part is aligned with the longitudinal axis of the base part. This pivotal movement of the protective part causes the clamping receiving devices forming the centering ribs to reach across the part of the tool protruding from the clamping base and with the completion of the pivoting motion of the protective part, this part of the tool is pressed into the clamping receiving devices and enters into engagement there. The tool thus is received in the protective part in secured position and the packaging unit—without the protective cap already pushed on—is ready for further processing. The tool does not drop out of the protective part and the clamping base. Due to the clamping engagement of the tool in the clamping part of the protective part, the further advantage is obtained because the protective part can no longer be unintentionally folded back out of the pivoting position aligned with the clamping base.

The actual clamping effect exerted onto the tool to be held, however, does not occur until the cap is pushed onto the protective part. For this purpose, the external side of the protective part in the area of the clamping part of the said protective part is to be equipped with external compression nubs, protrusions, thickened cross sections and similar items projecting beyond the clear outer circumference or perimeter of the protective part and interfering with or coming to rest against the internal side of the protective cap against frictional tightness. Consequently, the compression nubs and clamping part are pressed inward by the lateral walls of the cap.

For the sake of simplified description, the description below will describe clamping with compression nubs, although the invention is not restricted to compression nubs of this type.

When pushing on the protective cap, the legs or lateral U-members of the clamping part are turned inward—against the elastomer spring load of the U-members—and pivoted, and the diameters of the clamping receiving devices disposed in this area are thus reduced by a substantial amount. In this way a tool seated in the clamping receiving device is clamped completely around an angular range of approximately 270°. It is consequently of importance that the maximum clamping force is not achieved until the cap is pushed onto the individual packaging unit and the compression nubs disposed on the U-members resiliently deform the said U-members inward, thereby reducing the clear width of the clamping receiving devices. The tool, having previously only been lodged in the clamping receiving device in secured position, now is finally anchored with high clamping force.

For this purpose, the protective part is to be designed in two parts and to comprise a clamping part and a receiving part disposed adjacent to the latter in longitudinal direction. The clamping part is separated from the receiving part by walls with weakened cross sections or by complete slits.

The clamping part cross section preferably consists of a body with U-shaped profile, wherein the external sides of the two legs or lateral members are equipped with the above mentioned compression nubs and wherein, when the protective cap is pushed onto the said compression nubs, the two lateral members are deformed elastically in relation to one another and reduce the diameter of the clamping receiving device disposed between the two lateral members.

Aside from the design of the protective part as U-profile, other profiles open on one side may also be chosen, such as for example rectangular or square or oval or round profiles.

A preferred improvement provides for the two-part protective part with the clamping part thereof and the receiving part thereof to be designed in such a way that the clamping part is disposed immediately adjacent to the film hinge forming the horizontal rocket pivot of the protective part on the base part.

However, the invention is not restricted to this. It may also be provided that the film hinge first merges into a non-clamping receiving part, that then, by means of corresponding cuts or walls with weakened cross sections, a clamping part is formed adjacently, said clamping part again merging into a non-clamping receiving part.

The type and position of the clamping part depends on the length of the shaft to be held of the precision tool.

The subject matter of the present invention derives not only from the subject matter of the individual patent claims, but also from the combination of individual patent claims.

All data and features disclosed in the documentation, including the abstract, and in particular, the spatial design represented in the drawings, are claimed as essential for the invention insofar as they are novel individually or in combination in relation to the prior art.

BRIEF DESCRIPTION OF THE DRAWINGS

Below, the invention is explained in more detail with reference to drawings representing several embodiments. In this context, further features and advantages essential for the invention are derived from the drawings and the description thereof.

The drawings show in:

FIG. 7: The same representation as in FIG. 6 with the protective cap being pushed on;

FIG. 11: The section through the clamping part with protective cap pushed on.

DESCRIPTION OF A PRESENTLY PREFERRED EMBODIMENT

Figure 1:
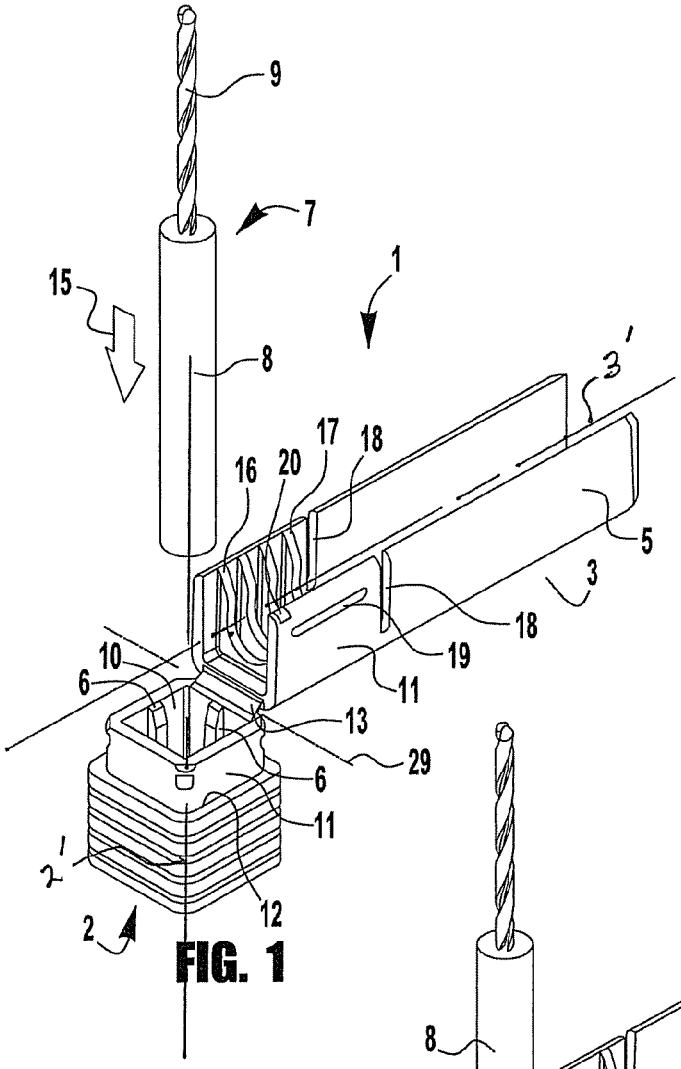
FIG. 1: An individual packaging unit for precision tools in perspective lateral view in loading position.
Figure 3:
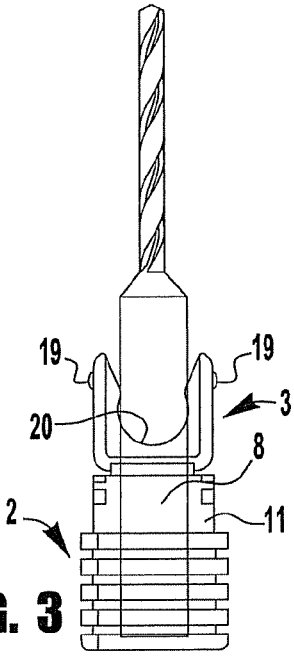
FIG. 3: The front view of the representation according to FIG. 2.
Figure 4:
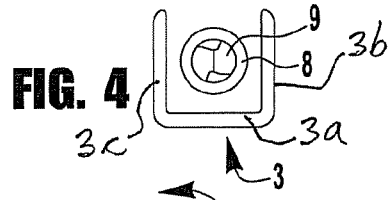
FIG. 4: According to the cut along the line 4-4 in FIG. 2 through the protective part.
Figure 2:
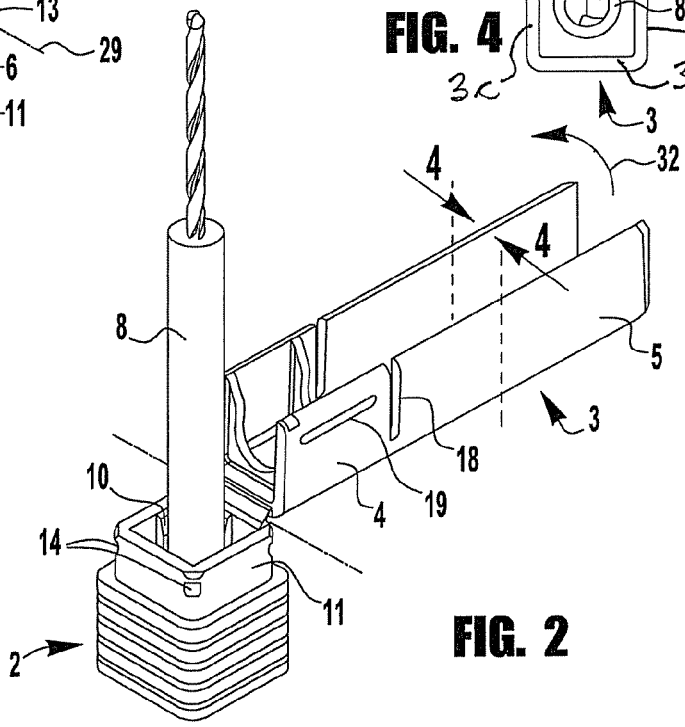
FIG. 2: The same representation as in FIG. 1 with loaded individual packaging unit.

In FIGS. 1 and 2, an individual packaging unit 1 is generally shown including three parts, namely, a base part 2, a protective part 3 that is pivotally connected to the base by a film hinge 13, and a protective cap 24. Film hinge 13 is located on a horizontal axis 29 that is orthogonal to the longitudinal axis 2' of base 2. Protective cap 24 encloses the entire protective part of the individual packaging unit 1.

In the loading position represented in FIG. 1, the cylindrical tool shaft 8 of a tool 7 is dropped into the receiving opening 10 that is defined by base part 2. Receiving opening 10 opens at the top and is disposed in the base part 2. The tool falls in the direction of the arrow direction 15, wherein it is preferred to have the receiving opening 10 envelop the tool shaft 8 with little clearance so that the tool shaft drops into the base part 2 due only to gravity.

Figure 5:
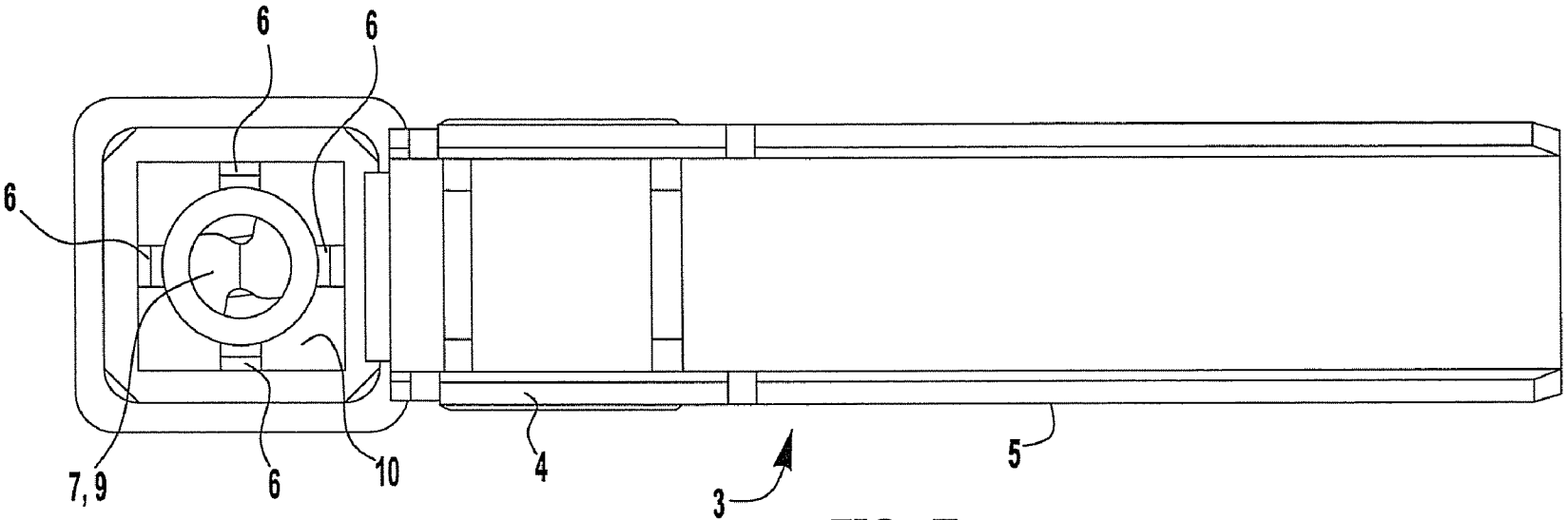
FIG. 5: The top view on an arrangement according to FIG. 2.

The receiving opening 10 is equipped with guidance ribs 6 disposed equidistant from one another on the circumference of receiving opening 10 as can be seen also in FIG. 5.

It is not necessary for the packaging unit to have a total of four guidance ribs 6 that form the receiving opening 10. More than four guidance ribs 6, or even three guidance ribs, may also be provided.

Instead of the guidance ribs, other holding means can also be used, such as for example a guidance ring that defines a corresponding receiving opening 10.

In any case, it is of importance that in the area of the receiving opening 10, practically no or only very little clamping effect is exerted by base 2 on tool 7 so that tool 7 drops into the receiving opening 10 due to weight and gravity, or that the tool 7 is inserted into the receiving opening 10.

The base part 2 is a synthetic material body manufactured by injection molding in one piece with the protective part 3 connected to the base part. Equally, the film hinge 13 is built in one piece with and linked to not only the base part, but also the protective part 3.

The base part 2 defines a square hollow body with a row of grip ribs disposed on the external side thereof. The said grip ribs may also be omitted. Here, a collar 11 with an outside diameter that is less than the outside diameter of the grip ribs 12 is formed on the upper side of the grip ribs so that the top grip rib 12 forms a stop rib for a protective cap 24 as it is pushed longitudinally over the protective part 3.

Figure 7:
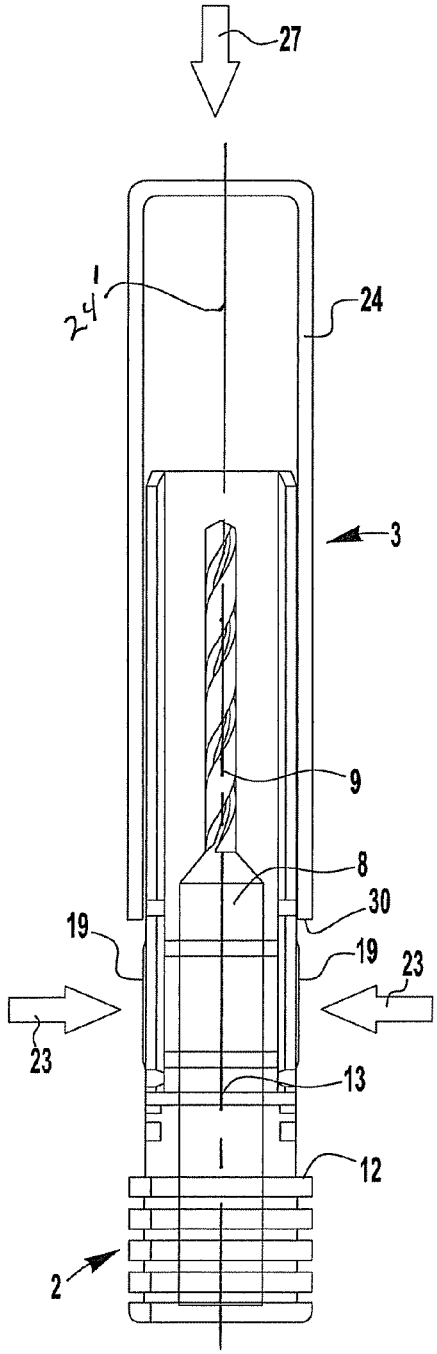

When protective cap 24 is completely pushed over the protective part 3, the lower edge 30 of the protective cap 24 contacts stop rib 12 as shown in FIG. 7 in the drawing. While protective cap 24 is being pushed over protective part 3, protective cap 24 engages protective part 3 and the base part 2, as will be explained in more detail below.

The protective part 3 is designed functionally in 2 parts and comprises a clamping part 4 and a receiving part 5.

Overall, the protective part 3 is designed as U-profile or cross-section. Protective part 3 includes a main member or backing 3*a* and adjacent thereto and integrally connected therewith, two lateral members or legs 3*b* or 3*c*.

Cuts 18 penetrate through the lateral legs 3*b* and 3*c* and delimit the clamping part 4 from the receiving part 5. Cuts 18 in the wall of the lateral members 3*b* and 3*c* provide lateral walls 3*b* and 3*c* of the clamping part 4 with elastic bendability. Cuts 18 are aligned with one another and located opposite one another, as shown in FIGS. 1 and 2.

In clamping part 4, two centering ribs 16, 17 are located in clamping part 4 at longitudinal positions along the longitudinal axis 3' of protective part 3 that are spaced apart from each other. Centering ribs 16, 17 form a clamping receiving device 21 for holding the tool 7. Alternatively, one single centering rib 16 or 17, or more than two centering ribs 16, 17 could also be used.

It is not required that the packaging unit provide a total of two centering ribs 16, 17 disposed at a distance from one another. For the purposes of the invention, one single centering rib 16 or 17, or more than two centering ribs could also be used.

Figure 9:
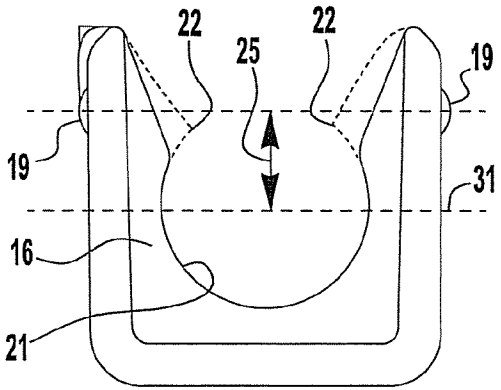
FIG. 9: A section through the clamping part of the protective part without inserted tool.

Compression nubs 19 are disposed on the external sides of the lateral members 3*b*, 3*c* of the clamping part 4. The outer dimensions of compression nubs 19 extend from the legs 3*b*, 3*c* by a dimension that exceeds the clearance between the external surfaces of legs 3*b*, 3*c* in clamping part 4 and the internal surface of the protective cap 24. This is shown in FIGS. 9-11.

Preferably, compression nubs 19 are designed as oblong nubs that are oriented with their longitudinal dimensions in the direction of the longitudinal axis 24' of the protective cap 24 as it is pushed over protective part 3 shown by the arrow 27.

The invention, however, is not restricted to this. Compression nubs 19 also may be designed as a single dot or may comprise a row of dots that are disposed in a linear array at equivalent distances from each other.

Figure 10:
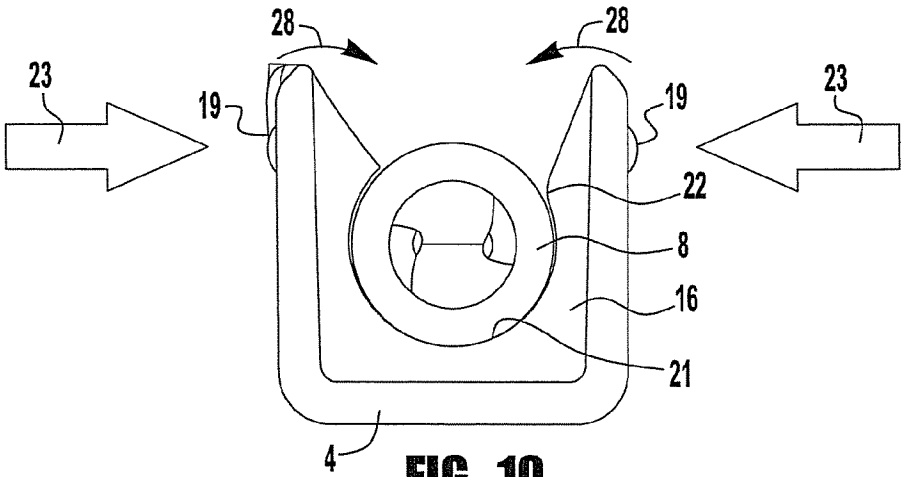
FIG. 10: The same section as in FIG. 9 with inserted tool with slight clamping.
Figure 11:
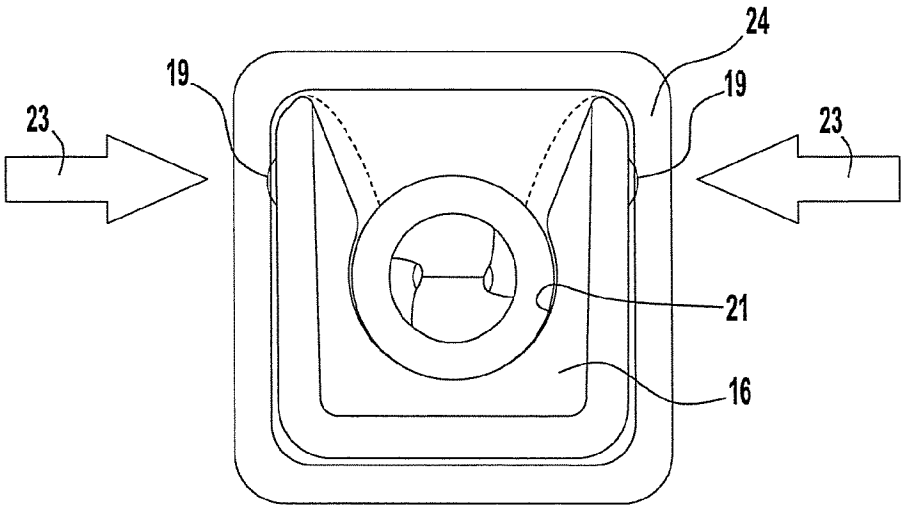

In an alternative embodiment, the U-member of protective part 4 may be constructed with thickening in the entire upper, pivotable area thereof, while the thickening may even reach into the area of the upper face (approximately into the area marked with arrow direction 28 in FIG. 10).

It is also of importance to have the compression nubs 19 disposed in the bendable areas of the two lateral members, as shown in FIG. 9.

Here it can be seen that the compression nubs 19 are disposed above the center line 31 at a distance 25 from the center line in the upper area of the two opposite lateral members 3*b*, 3*c* of the U-profile of clamping part 4. Thus, a compression force according to arrow direction 23 in FIG. 10 causes a corresponding inward bending motion of the lateral members 3*b*, 3*c* in the arrow directions 28. This inward sending motion of the lateral members causes the clear width of the clamping receiving device 21, i.e. the gap between clamping edges 22, to narrow as seen by comparing FIGS. 9 and 10.

In FIG. 9, the clamping receiving device 21 is more open toward the top so that the tool to be held can be introduced over the clamping edges 22 with low pressure and then is preliminarily held in the clamping receiving device 21.

FIG. 10 shows that after the tool passes between the clamping edges 22 and into the clamping receiving device, the clamping edges 22 then move toward one another and the clamping receiving device 21 as a whole closes, as can be seen by comparing FIGS. 9 and 10.

Thereby, a tool shaft 8 to be held is almost completely held (over a range of approximately 270°) in the clamping receiving device, secured against displacement, and can no longer be moved as soon as the cap is put on according to FIG. 11.

As shown in FIG. 11, when the cap 24 is longitudinally extended over the protective part 3, the internal sides of the cap run up against or interfere with the compression nubs 19, to compress the compression nubs 19 and walls 3*b* and 3*c* in the arrow direction 23. The lateral members 3*b*, 3*c* of the U-profile of the clamping part 4 pivot inward in the arrow directions 28 (FIG. 10), in order to close the clamping receiving device 21 with the shaft 8 held therein. Thus, the shaft 8 is held secured against displacement. Consequently, it is no longer possible for the tip 9 of the tool 7 to hit against any internal sides of the cap as was the case in the prior art.

When the cap 24 is pushed on, the cap enters into engagement not only with parts of the protective part 3, but also with the base part 2.

For this purpose, the cap is equipped with protrusions 26, directed inward, wherein the upper row of the protrusions 26 engages with the indentations 20 on the protective part 3 and simultaneously, a further engagement occurs with further protrusions 26 in the area of the indentations 14 on the circumferential collar 11 on the base part 2.

The protective cap 24 is consequently engaged twice, namely, on one hand with the protective part 3, and on the other hand, with the base part 2.

Figure 8:
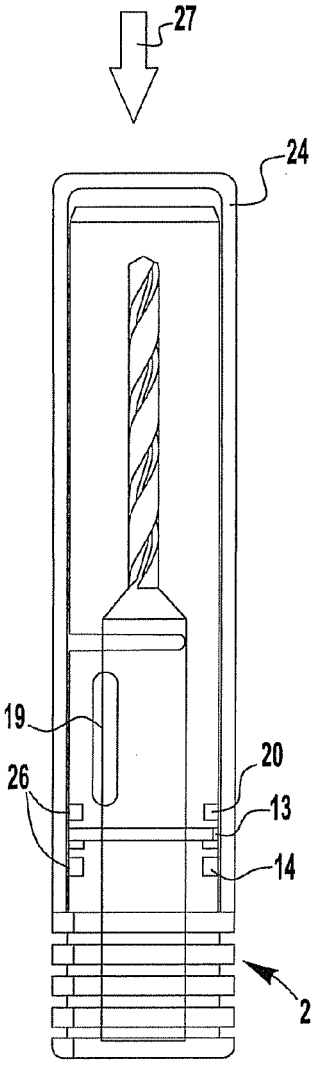
FIG. 8: The completed individual packaging unit with anchored protective cap.

Further, the protective cap is pushed on longitudinally in the arrow direction 27, as is shown in FIGS. 7 and 8.

A loading process according to the invention then evolves as follows:

According to FIG. 1, the shaft 8 of the tool 7 is dropped into the receiving opening 10 or is inserted with low force in the arrow direction 15. Next, the protective part 3 is pivoted in the arrow direction 32 around the horizontal axis 29 in the area of the film hinge 13, whereby the two centering ribs 16 and 17 disposed one behind the other, along with the clamping receiving devices 21 thereof disposed there are caused to tap on the tool shaft 8 one after the other. The tool shaft thus has to surmount the clamping edges 22 while the clamping receiving devices 21 are still open.

Therefore, the tool to be held is already held preliminarily in the base part 2 and the protective part 3, secured in its position, because it is held in the protective part 3 in a slight clamping bond and thus no longer being able to drop out of the upward-open receiving opening 10 in the base part 2. Consequently, the packaging loaded in this manner can easily be further processed.

Figure 6:
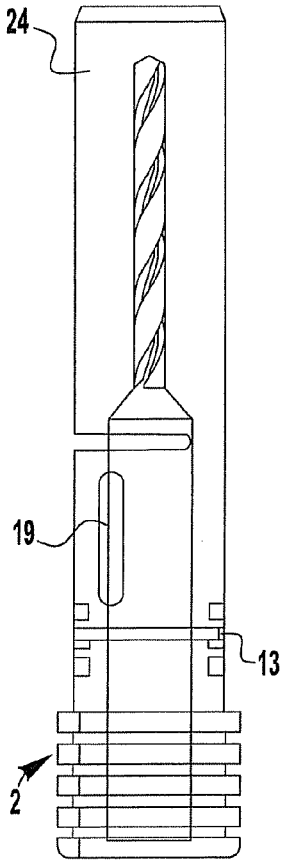
FIG. 6: The lateral view of the completely loaded individual packaging unit, though without protective cap.

In the next processing step as shown in FIGS. 6 through 8, the protective cap 24 is pushed onto the protective part 3 in the arrow direction 27, i.e. in such a way that the protrusions 26 disposed on the internal side of the walls of the protective cap enter into engagement with the indentations 14, 20 disposed on the base part 2 and the protective part 3.

During the said movement of pushing on the protective cap, the compression nubs 19 with enlarged cross section come to rest against or interfere with the internal side of the cap and thus are pressed inward, as is shown in FIG. 10. Thereby the two lateral members 3*b*, 3*c* of the U-profile of the clamping part 4 are moved toward one another and the clamping receiving devices 21 of the two aligned centering ribs 16, 17, disposed one behind the other, thus are closed around the tool shaft 8. The tool shaft 8 is thereby held in the clamping receiving device of the clamping part 4 with extraordinarily strong clamping force.

In this manner, the individual packaging unit is completely finished and can be shipped.

An advantage of the measures named lies in the fact that an extraordinarily secure anchoring, secured against displacement, of the tool 7 in the protective part 3 is achieved and that the actual clamping bond between the protective part 3 and the sensitive tool 7 does not occur until the protective cap 24 is pushed on in the arrow direction 27. In this position, however, the tool is already held and protected in the receiving device of the protective part 3 and the base part 2 and therefore can no longer be damaged when the cap is pushed on.

DRAWING LEGEND

| | |
|---|---|
| 1 | Individual packaging unit |
| 2 | base part |
| 3 | protective part |
| 4 | clamping part |
| 5 | receiving device |
| 6 | guidance rib |
| 7 | tool |
| 8 | tool shaft |
| 9 | tip |
| 10 | receiving opening |
| 11 | collar |
| 12 | gripping and/or stop rib |
| 13 | film hinge |
| 14 | indentation |
| 15 | arrow direction |
| 16 | centering rib |
| 17 | centering rib |
| 18 | cut |
| 19 | compression nub |
| 20 | indentation |
| 21 | clamping receiving device |
| 22 | clamping edge |
| 23 | arrow direction |
| 24 | protective cap |
| 25 | distance |
| 26 | protrusion (protective cap 24) |
| 27 | arrow direction |
| 28 | arrow direction |
| 29 | axis |
| 30 | edge |
| 31 | center line |
| 32 | arrow direction |

The invention claimed is:

1. Packaging for a tool that has a shaft, said packaging comprising:

a base that defines an internal opening for receiving the shaft of said tool, said internal opening being sized to receive the shaft of said tool with clearance between the tool and the walls of said internal opening;

a protective part that is pivotally connected to the base part, said protective part having a groove-shaped device for receiving the tool, said protective part having a first section that clamps said tool and a second section that receives said tool; and a protective cap that is movable in a longitudinal direction over the protective part to contact said base and to close said packaging, said protective cap engaging the first section of said protective part and actuating the first section of said protective part to clamp said tool at times when said protective cap is extended over the first section.

2. The packaging of claim 1 wherein the first section of said protective part includes centering ribs that clamp the tool in response to extending the protective cap over the first section.

3. The packaging of claim 2 wherein the second section of said protective part partially surrounds the tool at times when the tool is placed in the protective part.

4. The packaging of claim 3 wherein the second section of said protective part has a U-shaped cross-section.

5. The packaging of claim 4 wherein the first section of said protective part has a U-shaped cross-section and is constructed in a unitary body with the second section of said protective part.

6. The packaging of claim 1 wherein said base includes a collar that defines a portion of the internal opening of said base, said collar having an outer dimension that is less than the outer dimension of said base, said base being of integral construction and connected to the protective part by a film hinge that pivots about an axis that is orthogonal to the longitudinal axis of the base.

7. The packaging of claim 1 wherein said base includes guidance ribs that partially define the lateral walls of said internal opening, said guidance ribs being longitudinally aligned with the longitudinal axis of the base, said guidance ribs limiting function tightness between the tool and the base.

8. The packaging of claim 1 wherein said base includes a guidance ring that partially defines the lateral walls of said internal opening, said guidance ring limiting friction tightness between the tool and the base.

9. The packaging of claim 1 wherein said base includes a gripping rib, said protective cap being longitudinally extendable over said protective part and contacts the gripping rib of said base.

10. The packaging of claim 5 wherein the first section of the protective part is separated from the second section of the protective part by cuts in the lateral legs of the U-shaped protective part, said cuts increasing the flexibility of the lateral legs of the U-shaped first section.

11. The packaging of claim 2 wherein said centering ribs are located at longitudinal positions that are spaced apart from each other, said centering ribs cooperating to form a clamping receiving device that holds the tool.

12. The packaging of claim 11 wherein said clamping receiving device defines a gap between two opposed clamping edges, said gap being oriented toward the opening between the lateral legs and also being less than the cross-sectional dimension of the tool, said clamping receiving device being elastic such that when said tool is forced against said opposed clamping edges the opposed clamping edges move apart to admit said tool into the clamping receiving device and when said tool passes through said gap between said clamping edges, the clamping edges return to their unstressed position so that the clamping receiving device captures the tool.

13. The packaging of claim 12 wherein said protective part includes compression nubs that are located on the external surface of the lateral legs, said nubs extending orthogonally away from the external surface by a dimension that is greater than the clearance between the external surface of the lateral legs and the protective cap such that said compression nubs interfere with the protective cap and cause the lateral legs to bend toward each other at times when the protective cap is moved over the first section of the protective part.

14. The packaging of claim 13 wherein said compression nubs are located on the external surface of the lateral legs and between the distal ends of the lateral legs and the body center line of said protective part.

15. The packaging of claim 14 wherein said compression nubs have an oblong shape.

16. The packaging of claim 13 wherein the lateral legs bend inwardly towards each other at times when the protective cap is moved over the first section of the protective part such that the gap between the two opposed clamping edges of the clamping receiving device is narrowed and the clamping receiving device clamps the tool.

17. The packaging of claim 16 wherein the clamping edges of said clamping receiving device mover closer together in response to the movement of said protective cap over the first section of said protective part.

18. The packaging of claim 6 wherein said protective cap includes inwardly directed protrusions and wherein said protective part includes indentations and wherein said base includes indentations that are located in the circumferential collar of said base, said protrusions of said protective cap engaging the indentations of said protective part and also engaging the indentations of said base at times when said protective cap is moved over the first section of said protective part.

19. A process for placing a tool in packaging that includes a base that is hinged to a protective part, said protective part including a clamping receiving device that is formed of two centering ribs with clamping edges that define gaps therebetween, said process comprising the steps of:

dropping the tool into a receiving opening that is defined in the base;

pivoting the protective part with respect to said base to bring the longitudinal axis of said protective part into alignment with the longitudinal axis of said base and causing the tool to pass through the gaps between the clamping edges of the centering ribs and so that the tool is captured in the clamping receiving device; and covering the protective part with a protective cap by moving the cap longitudinally over the protective part, said protective cap interfering with a portion of said protective part and causing said protective part to close the gaps between the clamping edges of the centering ribs to secure the tool in the packaging.

* * * * *